US006081684A

United States Patent [19]

Naganuma et al.

[11] Patent Number: 6,081,684

[45] Date of Patent: Jun. 27, 2000

[54] METHOD AND APPARATUS FOR IMAGE FORMING CAPABLE OF PERFORMING AN IMPROVED CIRCULATION OF DEVELOPER

[75] Inventors: Yoshiko Naganuma, Meguro-ku; Tsukuru Kai, Fujisawa, both of Japan

[73] Assignee: Ricoh Company, Ltd., Tokyo, Japan

[21] Appl. No.: 09/268,317

[22] Filed: Mar. 16, 1999

[30] Foreign Application Priority Data

Mar. 16, 1998 [JP] Japan ..... 10-065282
Feb. 8, 1999 [JP] Japan ..... 11-030513

[51] Int. Cl.[7] ..... G03G 15/09

[52] U.S. Cl. ..... 399/275; 399/277

[58] Field of Search ..... 399/264, 273, 399/274, 275, 284

[56] References Cited

U.S. PATENT DOCUMENTS 5,109,254 4/1992 Oka et al .
5,416,568 5/1995 Yoshiki et al. .
5,598,254 1/1997 Ikesue et al. .
5,774,772 6/1998 Kai et al. .

*Primary Examiner*—Arthur T. Grimley
*Assistant Examiner*—Hoang Ngo
*Attorney, Agent, or Firm*—Oblon, Spivak, McClelland, Maier & Neustadt, P.C.

[57] ABSTRACT

An image forming method for improving developer recirculation capability within a developer unit includes the steps of magnetically adsorbing a developer having magnetism onto a developer carrier by the action of a magnetic field generated by a magnetic field generating member to form a magnetic lobe, regulating the amount of developer in the magnetic lobe in accompaniment with rotation of the developer carrier about a longitudinal central axis by a developer regulating member disposed in a developer carrier rotating angular region extending from a position of a normal magnetic flux density inflection point, at which a component of the magnetic field normal to the developer carrier becomes zero, to a position of a normal magnetic flux density peak, at which the component of the magnetic field normal to the developer carrier exhibits a maximum value, in a direction in which the developer carrier is rotated, and developing a latent image on an image carrier using the magnetic lobe having a regulated amount of developer, wherein the magnetic field is generated such that a position of a tangential magnetic flux density peak, at which a component of the magnetic field tangential to the developer carrier exhibits a maximum value, immediately upstream of the developer regulating member in the direction in which the developer carrier is rotated, is positioned upstream of the position of the normal magnetic flux density inflection point in the direction in which the developer carrier is rotated.

14 Claims, 8 Drawing Sheets

METHOD AND APPARATUS FOR IMAGE FORMING CAPABLE OF PERFORMING AN IMPROVED CIRCULATION OF DEVELOPER

BACKGROUND OF THE INVENTION

1. Field of the Invention

The present invention relates to a method and apparatus for image forming, and more particularly to a method and apparatus for image forming which is capable of performing an improved circulation of developer.

2. Description of the Related Art

FIG. 1 generally illustrates an example of an image forming apparatus such as a copier, a facsimile, a printer, etc. The illustrated example of the image forming apparatus is an image forming apparatus 2 which includes a photosensitive medium rotating unit 4, a toner feeding unit 38, a transfer unit 8, a fixing unit 10, paper feeding cassettes, etc. The photosensitive medium rotating unit 4 includes an image creating device such as a photosensitive medium 15 as an image carrier, and a developing unit 16 for developing an electrostatic latent image formed on a photosensitive medium with a toner. These two units may be integrally or separately formed. A copy sheet fed from a desired paper feeding cassette is transported to a pair of registration rollers 17 by transport rollers or the like, transported to the transfer unit 8 with timing coincident with a toner image formed on the photosensitive medium 15, and receives the toner image transferred thereto. The copy sheet carrying an unfixed toner image is transported to the fixing unit 10, where the toner image is fixed, and then is ejected.

FIG. 2 schematically illustrates a main portion of the developing unit 16. The developing unit 16 is provided therein with a developer carrier 41, a developer regulating member 42, a developer stirring member 43, etc. A so-called doctor blade is one example of the developer regulating member 42. The developer carrier 41 has a rotatable non-magnetic sleeve 45 as a main body, and a magnetic field generating member 44 is fixedly arranged inside the sleeve 45. The developer carrier 41 is rotated in a direction indicated by an arrow A while carrying a developer (for example, a two-component developer consisting, for example, of a carrier and a toner, hereinafter simply called the "developer") which is magnetized by the action of a magnetic field generated by the magnetic field generating member 44 to transport the developer to a developing position.

In this event, the developer regulating member 42 regulates the amount of developer (developer holding amount) carried by the developer carrier 41. More specifically, the thickness of the developer carried on the developer carrier 41 and transported to the developing position is regulated by the developer regulating member 42. The developer stirring member 43 stirs and transports the developer within the developing unit 16.

FIG. 3 is a conceptual diagram illustrating the relationship between a magnetic field generated by the magnetic field generating member 44 including a plurality of magnetic poles (P1–P6) disposed within the developer carrier 41 and the position of the developer regulating member 42. Lines forming oval figures indicate a distribution of the magnitude of the magnetic field generated around the developer carrier 4 1, in the direction of the normal to the circumferential surface of the developer carrier (in this specification, simply referred to as the "normal magnetic flux density"). A larger extension of the oval figures in the radial direction of the developer carrier 41 represents a higher normal magnetic flux density at the respective rotating angular positions relative to the magnetic poles P1–P6 of the magnetic field generating member 44.

The developer contained in the developing unit 16 is drawn up by a draw-up pole P5 of the developer carrier 41 on the developer carrier 41 and held thereon. The drawn developer moves in accompaniment of the rotation with the developer carrier 41 in the direction A, such that the amount of the developer held on the developer carrier 41 is regulated to be constant by the developer regulating member 42 (in other words, the thickness of the developer on the developer carrier 41 is ideally constant after it passes the position at which the developer regulating member 42 is disposed). The developer having passed the developer regulating member 42 visualizes (or develops) an electrostatic latent image on an image carrier at the developing position. The developer having a reduced toner concentration due to the development is further transported in accompaniment with the rotation of the developer carrier 41 to again return into the developing unit 16. Then, the developer is separated from the developer carrier 41 by the action of a developer separating pole P4, and delivered toward the developer stirring member 43. When the amount of developer drawn up by the pole P5 exceeds a predetermined developer holding amount, an excessive portion of the developer is regulated by the developer regulating member 42 and therefore cannot pass the same, and such portion is removed from the developer carrier 41. The developer removed from the developer carrier 41 is separated from the developer carrier 41 as it is led by the surface of the developer regulating member 42, and drops due to its own weight at a point where the magnetic field does not act sufficiently thereon as indicated by an arrow C in FIG. 2.

Conventionally, the developer regulating member 42 is often positioned downstream of a rotating angular position at which a normal component of the magnetic field becomes zero (in this specification, called the "normal magnetic flux density inflection point") in the direction in which the developer carrier is rotated (this direction is hereinafter called the "developer carrier rotating direction). This is because the following inconveniences result from the regulation of the developer holding amount made at a position where the normal magnetic flux density is increased or at a position where the normal magnetic flux density inflection point exists. Specifically, if the developer holding amount is regulated at a position where the normal magnetic flux density is increased, i.e., where the magnetic field curve extends furthest away from the developer carrier 41 in the form of lobe (in the example of FIG. 3, where the solid line is largely separated from the developer carrier), the developer carrier 41 would have a large torque. Conversely, if the developer holding amount is regulated at a position where the normal magnetic flux density inflection point exists in the developer carrier rotating direction (i.e., where the magnetic field curve is close to the developer carrier), an insufficient developer binding force of the developer carrier 41 at the normal magnetic flux density inflection point would cause the developer holding amount to be unstable after the developer has passed the developer regulating member 42. Consequently, the thickness of the developer held on the developer carrier 41 would vary after the regulation, although a small torque required by the developer carrier 41 is preferable. Therefore, as illustrated in FIG. 3, the developer regulating member has been conventionally disposed at a position where the thickness of the developer carried on the developer carrier 41 begins to increase, i.e., at a midway position at which the normal component of the magnetic field becomes stronger, while avoiding the normal magnetic flux density inflection point. In this manner, the torque of the developer carrier 41 not being excessive is preferable, and the thickness of the developer is uniform after the regulation, thus preventing the inconveniences as mentioned above.

This positioning, however, is determined only in consideration of the developer holding amount regulated by the developer regulating member and drawn on the developer carrier, and a torque required by the developer carrier, whereas behaviors of the developer. which is regulated by the developer regulating member and returned to the developing unit, are out of consideration. Thus, with such simple positioning, the developer, which is regulated by the developer regulating member to return to the developing unit, would be pressed by the developer regulating member and separated from the developer carrier, after coming in contact with the developer regulating member, and pushed up over the surface of the developer regulating member in contact therewith. Then, the developer once drops by gravity at a point where it is free from the influence of the magnetic flux density of the developer carrier. The developer having dropped, however, is again drawn up by the developer carrier immediately. As a result, the circulation of the developer cannot progress in the entire developing unit so that the toner concentration is uneven within the developing unit, thereby causing problems such as an uneven image concentration and so on.

Conventionally, as a method of improving the capability of mixing a developer in a developing unit by stirring to eliminate an uneven toner concentration of the developer and so on, for example, as described in Japanese Laid-open Patent Publication No. JPAP09-080881 (1997), it is known to improve a developer stirring member to forcibly stir a new developer and a returned developer with the improved developer stirring member and so on to provide a uniform mixture of the developers. Disadvantageously, however, this method involves a complicated mechanism, an increase in unit torque, an increased number of parts, and so on to cause a higher cost. Therefore, such a method cannot satisfy the requirements for down sizing and energy saving.

SUMMARY OF THE INVENTION

It is therefore an object of the present invention to provide an image forming apparatus and an image forming method which are capable of improving the developer recirculation capability within a developer unit and the mixture stirring capability, avoiding faulty images such as those including an uneven toner concentration, an uneven image concentration and so on, and reducing the driving torque of the developing unit without increasing the number of parts.

To solve the problem mentioned above, in one aspect, the present invention provides an image forming method including the steps of magnetically adsorbing a developer having magnetism onto a developer carrier by the action of a magnetic field venerated by a magnetic field generating member to form a magnetic lobe, regulating the amount of developer in the magnetic lobe in accompaniment with rotation of the developer carrier about a longitudinal central axis by a developer regulating member disposed in a developer carrier rotating angular region extending from a position of a normal magnetic flux density inflection point, at which a component of the magnetic field normal to the developer carrier becomes zero, to a position of a normal magnetic flux density peak, at which the component of the magnetic field normal to the developer carrier exhibits a maximum, in a direction in which the developer carrier is rotated, and developing a latent image on an image carrier using the magnetic lobe having a regulated amount of developer, wherein the magnetic field is generated such that a position of a tangential magnetic flux density peak, at which a component of the magnetic field tangential to the developer carrier exhibits a maximum, immediately upstream of the developer regulating member in the direction in which the developer carrier is rotated, is positioned upstream of the position of the normal magnetic flux density inflection point in the direction in which the developer carrier is rotated.

In another aspect, the present invention provides an image forming apparatus which includes an image carrier, a non-magnetic sleeve serving as a developer carrier rotatable about a longitudinally central axis, a magnetic field generating member having a plurality of magnetic poles fixedly disposed one after the other in an internal space of the sleeve in a direction in which the developer carrier is rotated, for generating a magnetic field for holding a developer having magnetism on the surface of the developer carrier, and a developer regulating member for regulating the amount of developer held on the surface of the developer carrier and transported to a developing position, the developer regulating member being disposed in a peripheral region of the developer carrier, wherein the peripheral region extends between two magnetic poles out of the plurality of magnetic poles, positioned adjacent to each other in the direction in which the developer carrier is rotated, within an angular range, in which the developer carrier is rotated, extending from a position of a normal magnetic flux density inflection point, at which a component of the magnetic field normal to the developer carrier becomes zero, to a position of a normal magnetic flux density peak, at which the component of the magnetic field normal to the developer carrier exhibits a maximum, in the direction in which the developer carrier is rotated, wherein a position of a tangential magnetic flux density peak, at which a component of the magnetic field tangential to the developer carrier exhibits a maximum, is disposed upstream of the position of the normal magnetic flux density inflection point in the direction in which the developer carrier is rotated, between the two magnetic poles.

In particular, it is advantageous that the position of the tangential magnetic flux density peak is disposed upstream of the position of the normal magnetic flux density inflection point by at least 3° in the direction in which the developer carrier is rotated.

Also, advantageously, within two positions of normal magnetic flux density peaks laying adjacent to each other on both sides of the developer regulating member are such that a normal magnetic flux density at the position of the normal magnetic flux density peak laying upstream in the direction in which the developer carrier is rotated is larger, particularly, by 150 G or more, than a normal magnetic flux density at the position of the normal magnetic flux density peak laying downstream in the direction in which the developer carrier is rotated.

Further preferably, the position of the tangential magnetic flux density peak is upstream of a median point of two tangential magnetic flux density zero positions at which a tangential component of the magnetic flux is zero before and after the position of the tangential magnetic flux density peak in the direction in which the developer carrier is rotated.

Within two positions of normal magnetic flux density peaks laying adjacent to each other on both sides of the developer regulating member, a half value central angular width of a normal magnetic flux density distribution including the position of the normal magnetic flux density peak upstream of the other position in the direction in which the developer carrier is rotated is preferably wider than a half value central angular width of a normal magnetic flux density distribution including the position of the normal magnetic flux density peak downstream of the other position in the direction in which the developer carrier is rotated.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
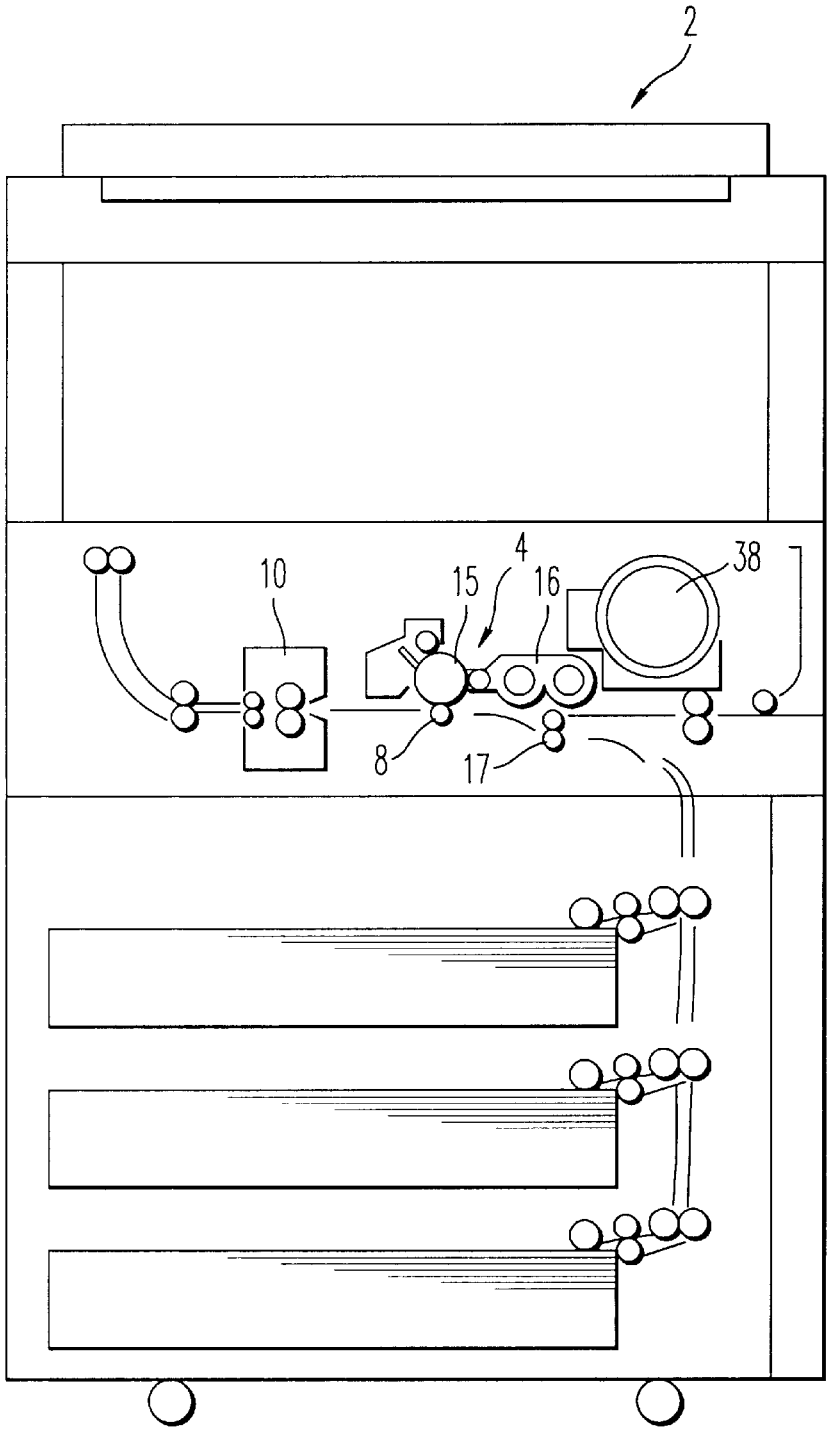
FIG. 1 PRIOR ART
FIG. 1 is a schematic diagram illustrating a prior art image forming apparatus.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Figure 4:
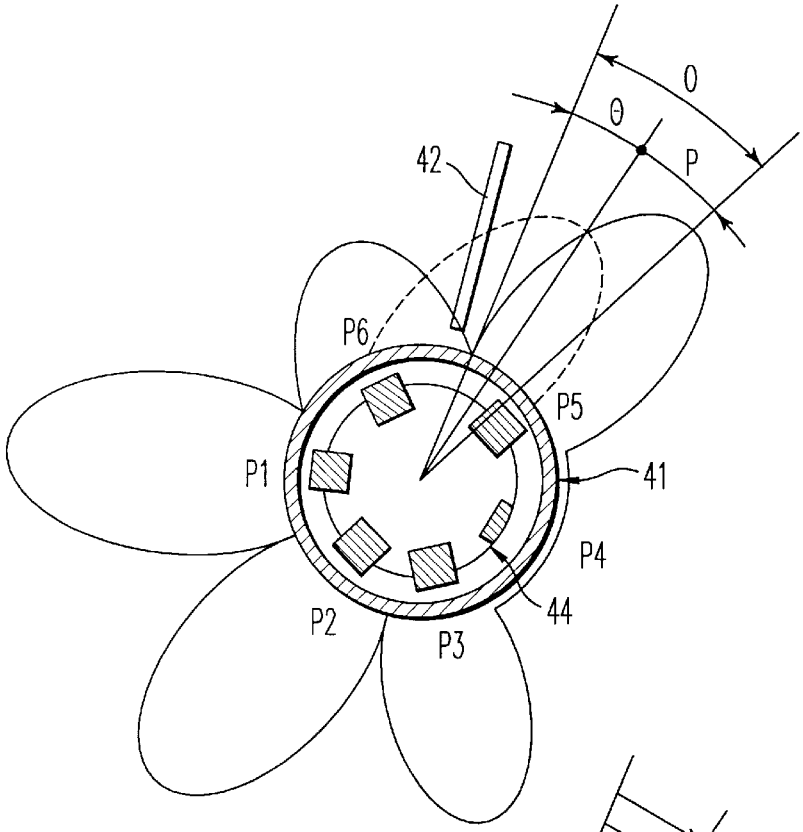
FIG. 4 is a conceptual diagram illustrating the relationship among the position (angle) of a normal magnetic flux density inflection point, the position (angle) of a tangential magnetic flux density peak position, and the position at which a developer regulating member is disposed.

Referring now to the drawings, wherein like reference numerals designate identical or corresponding parts throughout the several views, and more particularly to FIG. 4 thereof, there is illustrated a positional relationship between a developer carrier and a developer regulating member in one embodiment according to the present invention. Within a developer carrier 41, a plurality of magnetic poles are fixedly positioned as appropriate in a developer carrier rotating direction to implement a magnetic field generating member 44. Each of the magnetic poles has a polarity, a magnetic flux density and so on suitable for generating a magnetic field effective for the developer carrier to carry and transport a developer. Developer regulating member 42 is positioned in a magnetic field area in which a leading end of a magnetic lobe formed by the developer begins extending on the developer carrier (in this magnetic field region, a component of the magnetic field normal to the developer carrier 41 increases from zero to a maximum with respect to developer carrier rotating direction), avoiding a position coincident with a normal magnetic flux density inflection point (particularly, in this embodiment, a normal magnetic flux density inflection point between poles P5 and P6) of the magnetic field generated by the magnetic field generating member 44 around the developer carrier 41. In FIG. 4, the distribution of the normal magnetic flux density on the peripheral surface of the developer carrier 41 (i.e., a distribution of the magnitude of the component normal to the developer carrier) is indicated by a solid line around the developer carrier 41. The normal magnetic flux density presents the largest value at a rotating angular position at which the solid line indicating the change is furthest away from the developer carrier in the radial direction.

Particularly, in this embodiment, the magnetic field generating member 44 is designed such that the position of the first magnetic flux density peak in developer carrier rotating direction, upstream of the position at which the developer regulating member 42 is positioned in the developer carrier rotating direction (i.e. a rotating angular position at which the component of the magnetic field in the developer carrier rotating direction presents a maximum). This position is hereinafter referred to as the "tangential magnetic flux density peak position", i.e. a tangential magnetic flux density peak position of the magnetic field with respect to P5 pole and P6 pole is upstream of the position of the normal magnetic flux density inflection point, referred to above, in the developer carrier rotating direction, and downstream of the position at which the normal component of the magnetic field with respect to P5 pole exhibits a peak in the developer carrier rotating direction.

Figure 5:
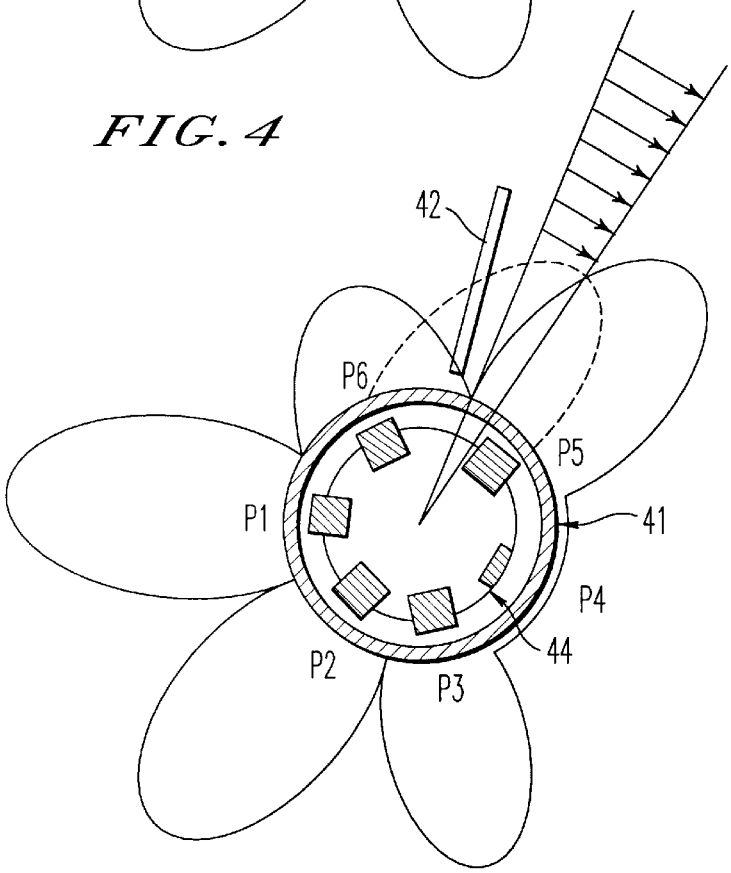
FIG. 5 is a conceptual diagram illustrating the action of the magnetic field affecting a developer near a developer regulating member in the positional relationship illustrated in FIG. 4.

In FIG. 4, the distribution of the magnitude of the tangential magnetic flux density including the tangential magnetic flux density peak position is indicated by a broken line. The rotating angular position at which the broken line is furthest away from the developer carrier in the radial direction is the tangential magnetic flux density peak position. For example, it is possible to control the position at which the tangential magnetic flux density exhibits a peak by changing a peak value of the normal magnetic flux density and a magnetic flux density waveform of each of the magnetic poles which form parts of the magnetic field generating member 44 provided in the developer carrier, particularly, each of magnetic poles acting on the position at which the developer regulating member is disposed (P5 pole and P6 pole in the embodiment of FIG. 4). By positioning the developer regulating member 42 at the above-mentioned position with the tangential magnetic flux density peak position located upstream of the position of the normal inflection point as mentioned above, the magnetic field acts on a developer regulated by the developer regulating member 42, removed from the developer carrier 41 and circulated to the developing unit 16 in a direction in which a contact resistance with the developer regulating member 42 is reduced (see FIG. 5). Stated another way, when a portion of the developer carried by P5 pole regulated by the developer regulating member 42 and remaining in the developing unit is pressed against the developer regulating member 42 to escape upward along a lateral surface of the developer regulating member 42, this portion of the developer is applied with a force toward the inside of the developing unit by the action of the magnetic field. Since the circulation is started with the developer affected by the magnetic field as mentioned, a developer circulating speed is improved in a direction away from the developer carrier along the surface of the developer regulating member 42. As a result, as indicated by an arrow B in FIG. 6, the developer is transported to a relatively remote point along the developer regulating member 42, and drops in the developing unit 16 by gravity. Thus, the developer circulating ability is improved in the developing unit. In addition, since the developer is more readily removed from the developer carrier 41, the developer carrier 41 only requires a small torque.

Figure 7A:
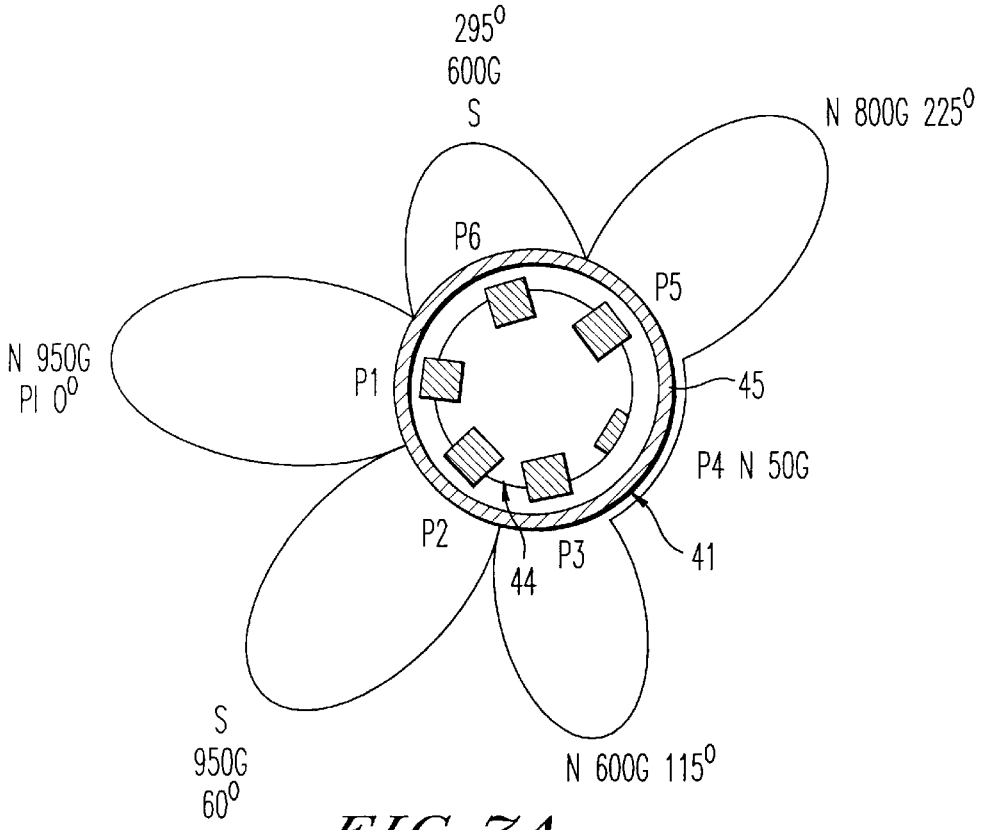
FIG. 7A is a conceptual diagram illustrating in solid waveform a distribution of a normal component of a magnetic field (magnetic flux density) generated on the surface of the developer carrier by magnetic field generating member according to one embodiment of the present invention.
Figure 7B:
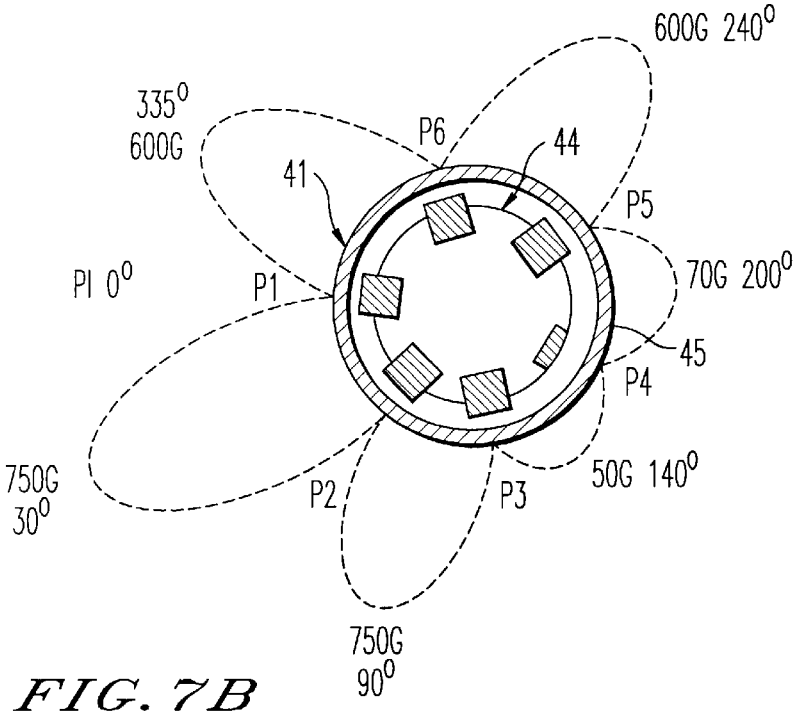
FIG. 7B is a conceptual diagram illustrating in broken waveform a distribution of a tangential component of the magnetic field.

As a practical example, it has been confirmed that by inclining the tangential magnetic flux density toward the upstream by 3° or more, i.e., by the tangential magnetic flux density peak position generated upstream of the normal magnetic flux density inflection position previously referred to, by 3° in the developer carrier rotating direction, between P5 pole and P6 pole, the developer circulating ability is improved in the developing unit 16. It has been also confirmed that the inclination of the tangential magnetic flux density toward the upstream can be achieved by increasing the magnetic flux density of the magnetic pole P5 upstream of the developer regulating member 42 more than the magnetic flux density of the magnetic pole P6 downstream of the developer regulating member 42. FIGS. 7A and 7B illustrate magnetic flux density distributions in the normal direction and the tangential direction, respectively, generated by the magnetic field generating member 44 according to one embodiment of the present invention. In FIG. 7A, the normal magnetic flux density distribution on the surface of the developer carrier 41 is drawn in a solid line. In FIG. 7B, the tangential magnetic flux density distribution on the surface of the developer carrier 41 is drawn in a broken line.

Figure 6:
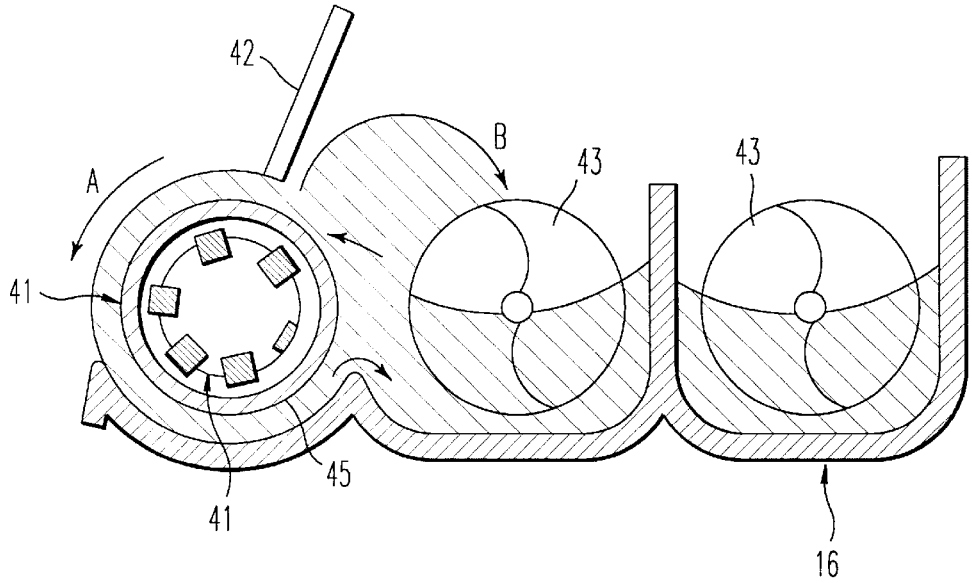
FIG. 6 is a schematic diagram conceptually illustrating movements of the developer in a developing unit in the embodiment illustrated in FIG. 4.

The developer carrier 41 provided in the developing unit 16 illustrated in FIG. 6 is positioned close to a photosensitive drum 15 (see FIG. 1) serving as a latent image carrier, so that a developing region is formed in opposing portions of the two parts. A main body of the developer carrier 41 may be implemented by a developing sleeve 45 made of a non-magnetic material such as aluminum, brass, stainless steel, conductive resin or the like which is formed in a cylindrical shape. The developing sleeve 45 is rotated by a rotating or driving mechanism, not shown, in a direction indicated by an arrow A, i.e. in the counter-clockwise direction. In one embodiment of the present invention, the diameter of the photosensitive drum 15 is set to be 30 mm, and a drum line velocity is set at 90 mm/sec. Also, the diameter of the developing sleeve 45 is set to be 16 mm, and a sleeve line velocity is set at 225 mm/sec. Thus, the ratio of the drum line velocity of the photosensitive drum 15 to the sleeve line velocity of the developing sleeve 45 is calculated to be 2.5. A developing gap, which is the spacing between the photosensitive drum 15 and the developing sleeve 45, is set to be 0.6 mm.

The magnetic field generating member 44 is fixedly disposed in the developing sleeve 45 for forming a magnetic field such that the developer is extended on the surface of the developing sleeve 45. In this event, carrier particles forming part of the developer extend over the developing sleeve 45 like a chain along magnetic lines of flux generated from the magnetic field generating member 44, and charged toner particles are attached to the carrier particles extending like a chain to form a magnetic lobe. The magnetic lobe is transported with the rotation or transportation of the developing sleeve 45 in the same direction as the developing sleeve 45 (in the counterclockwise direction in FIG. 5). The magnetic field generating member 44 includes a plurality of magnetic poles. More specifically, but by way of example only, a main magnetic pole P1 is disposed in the developing region for extending the developer; the magnetic pole P5 is disposed on the developing sleeve 45 for drawing up the developer on the developing sleeve 45; and the magnetic pole P6 is disposed on the developing sleeve 45 for transporting the drawn developer to the developing region. In a post-developing region, magnetic poles P2, P3 are disposed for transporting the developer back to the developing unit. A magnetic pole P4 is used to remove a portion of the developer, which is subsequently transported back to the developing unit, from the developing sleeve 45 (see FIG. 4). Each of the magnetic poles P1–P6 is oriented in the radial direction of the developing sleeve 45. Thus, magnetic flux lines generated from the respective magnetic poles are initially oriented in the radial direction of the developing sleeve 45. In this embodiment, a magnet roller 41 serving as the developer carrier 41 is formed of magnets of six poles. However, for improving a drawing up ability and a black solid image reproductivity, magnetic poles may be additionally disposed within the spacing from P5 pole to the doctor 42 serving as the developer regulating member 42 to form a magnetic roller having eight or more poles.

Figure 8:
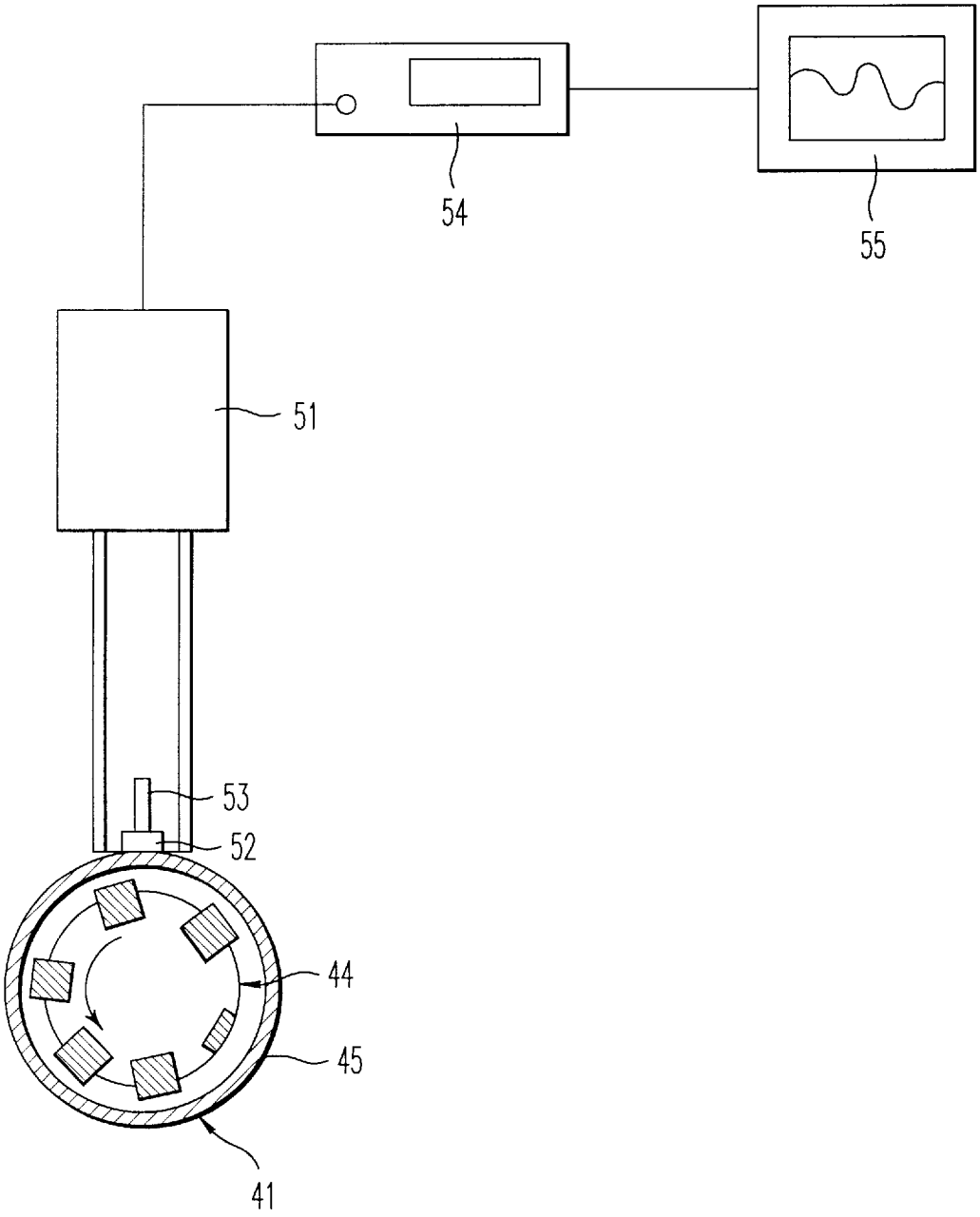
FIG. 8 is a schematic diagram illustrating an apparatus used to measure magnetic flux density distributions on the surface of the developer carrier.

FIG. 8 schematically illustrates an apparatus which used to measure a magnetic flux density distribution on the surface of the developing sleeve. The measuring method involves rotating the magnetic field generating member 44 with a magnetic flux density distribution measuring probe 51 maintained in contact with the surface of the developing sleeve, detecting voltage values using a normal magnetic flux density measuring element 52 and a tangential magnetic flux density measuring element 53 of the magnetic flux density distribution measuring probe, amplifying the detected voltage values by a Gauss meter 54 or the like, and recording the voltage values together with rotating angles in a recorder such as that indicated by 55 in FIG. 8. The normal magnetic flux density measuring element 52 is disposed near the surface of the developing sleeve, and the tangential magnetic flux density measuring element 53 is disposed perpendicularly to the normal magnetic flux density measuring element 52.

Figure 2:
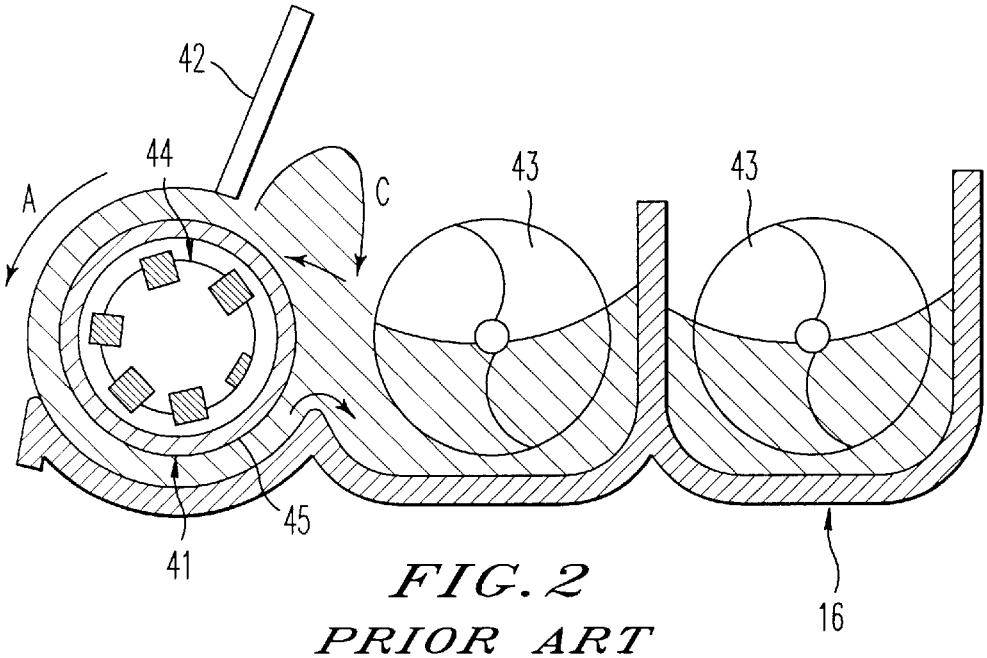
FIG. 2 PRIOR ART
FIG. 2 is a schematic diagram illustrating the interior of a developing unit of the prior art image forming apparatus of FIG. 1.
Figure 3:
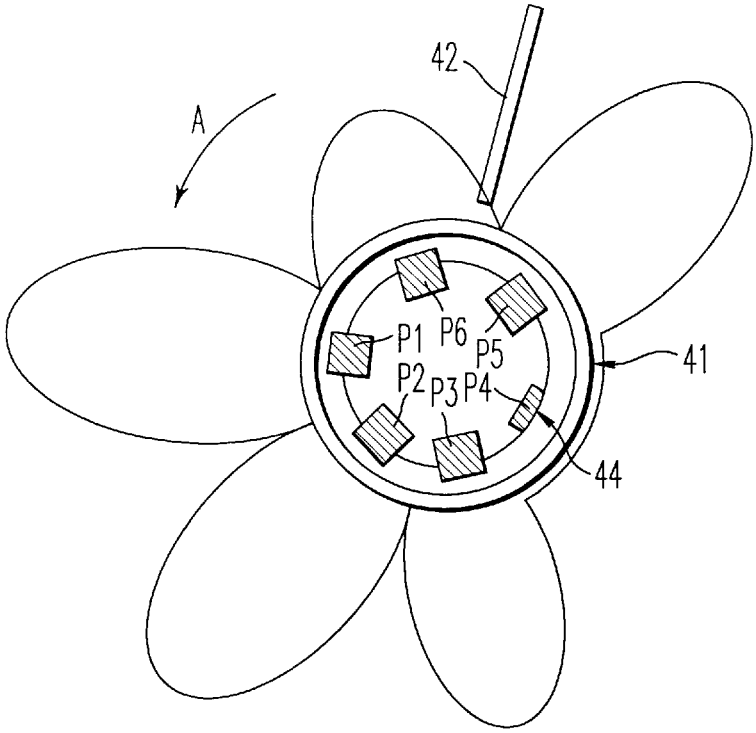
FIG. 3 PRIOR ART
FIG. 3 is a conceptual diagram illustrating the relationship between a magnetic field generated around a developer carrier by magnetic field generating member and a position at which a developer regulating member is disposed commonly used in the prior art image forming apparatus of FIG. 1.
Figure 9:
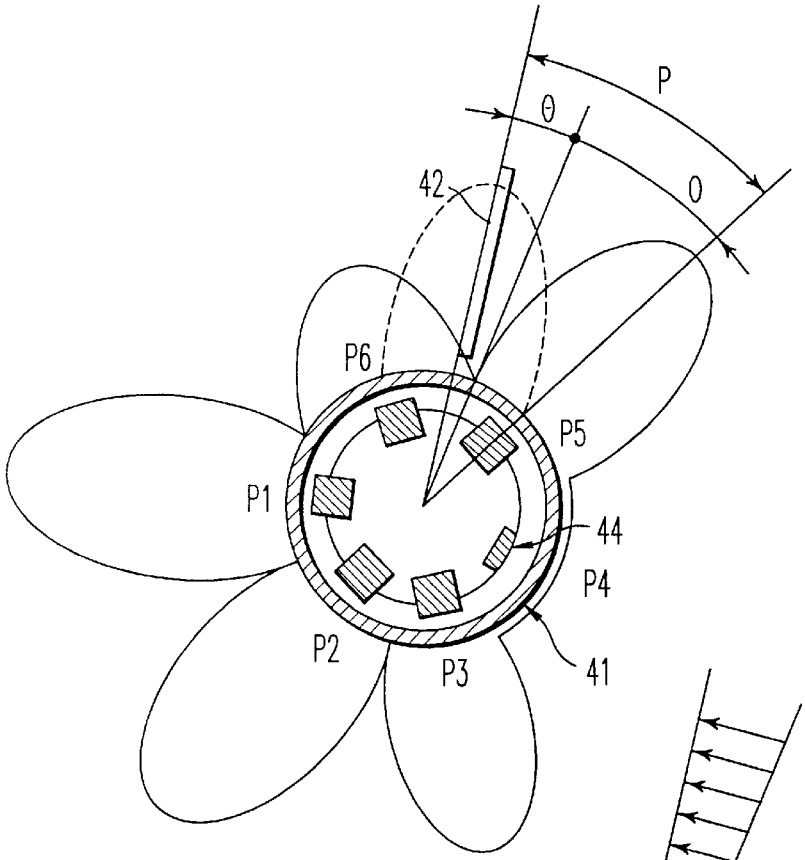
FIG. 9 is a diagram similar to FIG. 4 illustrating the relationship among the position (angle) of a normal magnetic flux density inflection point, the position (angle) of a tangential magnetic flux density peak, and the position at which a developer regulating member is disposed, in a comparative example.
Figure 10:
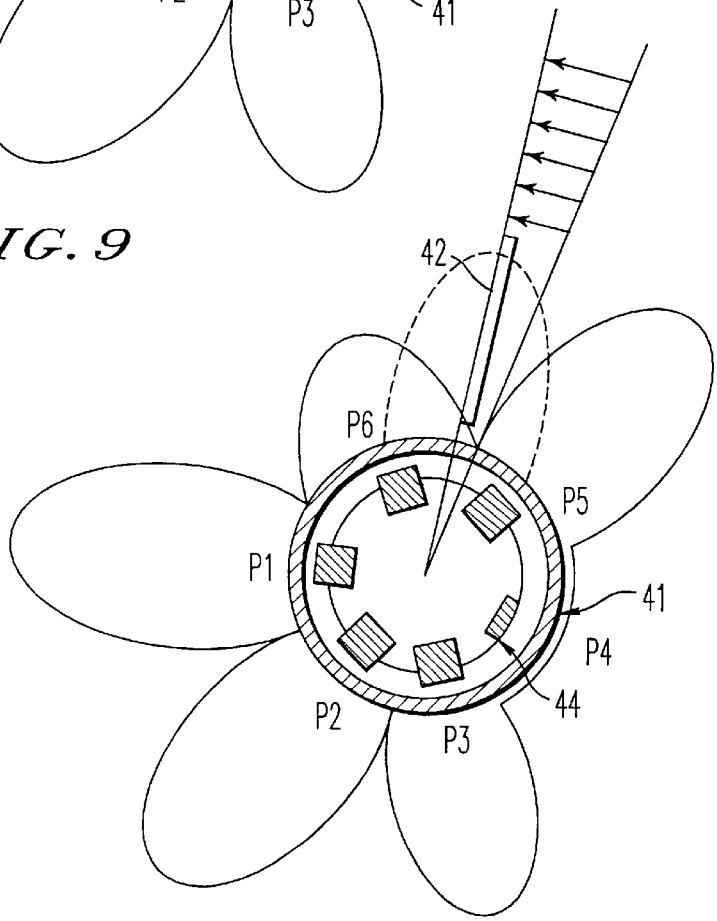
FIG. 10 is a diagram similar to that of FIG. 9 showing a plurality of arrows which represent the fact that a developer regulated by the developer regulating member to remain in the developing unit is pressed against the developer regulating member with a relatively large force.

FIG. 9 illustrates the relationship between the position at which the developer regulating member 42 is disposed and the tangential magnetic flux density peak position, as a comparative example. In this comparative example, a magnetic field is generated such that the tangential magnetic flux density peak position appears downstream of the position of the normal magnetic flux density inflection point, previously referred to, in the developer carrier rotating direction. In this case, a developer regulated by the developer regulating member 42 to remain in the developing unit 16 is pressed against the developer regulating member 42 with a larger force as compared with the foregoing embodiment (see FIG. 10). The developer is transported upward along the surface of the developer regulating member 42 while receiving such a pressing force, so that the developer impinges on the developer regulating member 42 with a larger force, resulting in a low developer circulating speed. Consequently, the developer is not transported to a remote point along the developer regulating member 42, as indicated by an arrow C in FIG. 2, and instead drops by gravity relatively near the developer carrier 41. Also, in this comparative example, a low developer circulating speed in the developing unit 16 causes retention of the developer which should be drawn up on the developer carrier 41 by the draw-up pole (P5 pole) of the developer carrier 41, and held and transported on the developer carrier 41, resulting in an increased torque of the developer carrier 41. Further, since the developer which is regulated by the developer regulating member 42 and should be circulated to the developing unit drops relatively near the developer carrier, the developer is again drawn up immediately by the developer carrier 41. As a result, the circulation of the developer is prevented in the entire developing unit so that the toner concentration is uneven within the developing unit, thereby causing troubles such as an uneven image concentration and so on.

Figure 11:
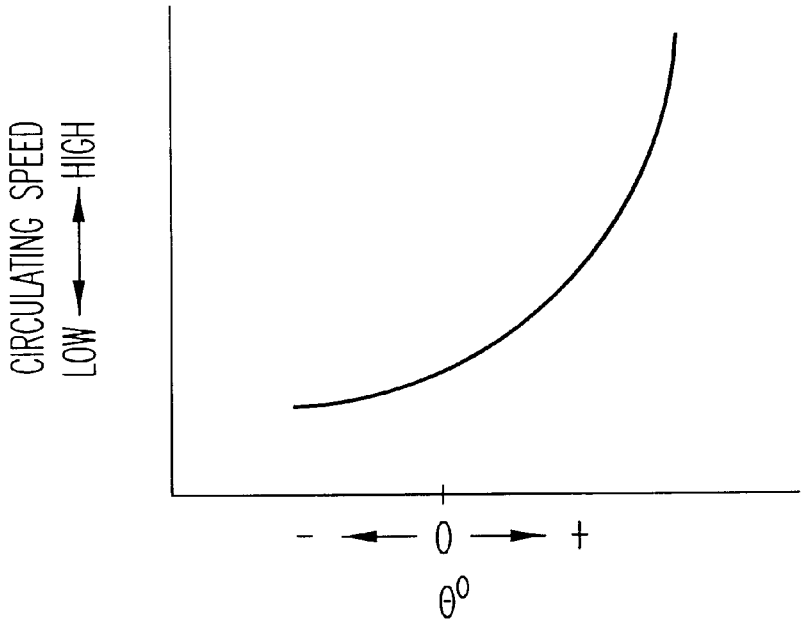
FIG. 11 is a graph generally illustrating the relationship between a difference in angle θ (equal to angle O less the value of angle P) between the position O of a normal magnetic flux density inflection point and the position P of a tangential magnetic flux density peak, and a circulating speed.
Figure 12:
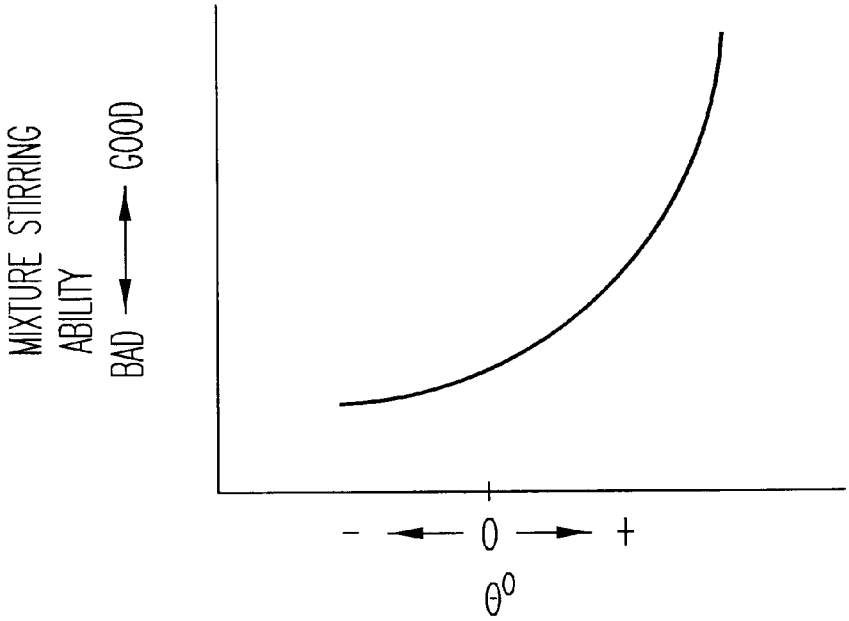
FIG. 12 is a graph generally illustrating the relationship between a difference in angle θ (equal to angle O less the value of angle P) between the position O of the normal magnetic flux inflection point and the position P of the tangential magnetic flux density peak, and a mixture stirring ability.

FIGS. 11 and 12 schematically show the results of a circulating speed and a mixture stirring ability, observed in experiments, derived by changing the relationship between the position of the normal magnetic flux density inflection point of the magnetic field generated around the developer carrier 41 (an angle from an appropriate reference position) and the position of the tangential magnetic flux density peak (an angle from the reference position). Assuming that the angle difference θ between the angle O at the position of the normal magnetic flux density inflection point and the angle P1 at the tangential magnetic flux density peak position is expressed by:

θ=(angle O at the position of the normal magnetic flux density inflection point)−(angle P at the tangential magnetic flux density peak position), the following results were observed (see FIG. 12):

θ=+(the present invention, FIG. 4); good mixture stirring ability;

θ=0°; mediocre mixture stirring ability; and

θ=−(comparative example; FIG. 9); bad mixture stirring ability.

It will be understood from the above that the circulating speed is increased (i.e., the circulating ability is improved), and the mixture stirring ability is improved by defining θ as follows:

θ=(angle O at the position of the normal magnetic flux density inflection point)−(angle P at the tangential magnetic flux density peak position)>0°

This invention may be conveniently implemented using a conventional general purpose digital computer programmed according to the teaching of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent application Nos. JPAP10-065282 filed in the Japanese Patent Office on Mar. 16, 1998 and JPAP 11-030513, filed on Feb. 8, 1999 in the Japanese Patent Office, respectively, the entire contents of which are hereby incorporated by reference.

What is claimed is:

1. An image forming method, comprising the steps of:

magnetically adsorbing a magnetized developer onto a developer carrier by the action of a magnetic field generated by a magnetic field generating means to form a magnetic lobe;

regulating the amount of said developer in said magnetic lobe in accompaniment with rotation of said developer carrier about a longitudinal central-axis by a developer regulating member disposed in a developer carrier rotating angular region extending from a position of a normal magnetic flux density inflection point, at which a component of said magnetic field normal to said developer carrier becomes zero, to a position of a normal magnetic flux density peak, at which said component of said magnetic field normal to said developer carrier exhibits a maximum value, in a direction in which said developer carrier is rotated; and developing a latent image on an image carrier using said magnetic lobe having a regulated amount of said developer, wherein said magnetic field is generated such that a position of a tangential magnetic flux density peak, at which a component of said magnetic field tangential to said developer carrier exhibits said maximum value, immediately upstream of said developer regulating member in the direction in which said developer carrier is rotated, is positioned upstream of said position of the normal magnetic flux density inflection point in the direction in which said developer carrier is rotated.

2. An image forming apparatus comprising:

an image carrier;

a non-magnetic sleeve serving as a developer carrier rotatable about a longitudinally central axis;

magnetic field generating means having a plurality of magnetic poles fixedly disposed in series in an internal space of said sleeve in a direction in which said developer carrier is rotated, said magnetic field generating means generating a magnetic field for holding a developer having a magnetized surface; and a developer regulating member for regulating the amount of developer held on the surface of said developer carrier and transported to a developing position, said developer regulating member being disposed in a peripheral region of said developer carrier, said peripheral region extending between two magnetic poles outwards of said plurality of magnetic poles, said two magnetic poles being positioned adjacent to each other in the direction in which said developer carrier is rotated, within an angular range in which said developer carrier is rotated, said angular range extending from a position of a normal magnetic flux density inflection point, at which a component of said magnetic field normal to said developer carrier becomes zero, to a position of a normal magnetic flux density peak, at which said component of said magnetic field normal to said developer carrier exhibits a maximum, in the direction in which said developer carrier is rotated, wherein a position of a tangential magnetic flux density peak, at which a component of said magnetic field tangential to said developer carrier exhibits a maximum, is disposed upstream of the position of the normal magnetic flux density inflection point in the direction in which said developer carrier is rotated, between said two magnetic poles.

3. The image forming apparatus according to claim 2, wherein said position of the tangential magnetic flux density peak is disposed upstream of said position of normal magnetic flux density inflection point by at least 3° in the direction in which said developer carrier is rotated.

4. The image forming apparatus according to claims 2 or 3, wherein two positions of peak normal magnetic flux density peaks lying in proximity with each other on both sides of said developer regulating member are such that a normal magnetic flux density at the position of the normal magnetic flux density peak laying upstream in the direction in which said developer carrier is rotated is larger than a normal magnetic flux density at the position of the normal magnetic flux density peak laying downstream in the direction in which said developer carrier is rotated.

5. The image forming apparatus according to claim 4, wherein the normal magnetic flux density at the position of the normal magnetic flux density peak laying upstream in the direction in which said developer carrier is rotated is larger by 150 G or more than the normal magnetic flux density at the position of the normal magnetic flux density peak lying downstream in the direction in which said developer carrier is rotated.

6. The image forming apparatus according to claim 2, wherein said position of the tangential magnetic flux density peak is located upstream of a median point of two tangential magnetic flux density zero positions at which a tangential component of the magnetic flux is zero before and after said position of the tangential magnetic flux density peak in the direction in which said developer carrier is rotated.

7. The image forming apparatus according to claim 2, wherein two positions of normal magnetic flux density peaks lying in proximity with each other on both sides of said developer regulating member are such that a one-half value of a central angular width of a normal magnetic flux density distribution including the position of the normal magnetic flux density peak upstream of the other position in the direction in which said developer carrier is rotated is wider than a half value of a central angular width of a normal magnetic flux density distribution including the position of the normal magnetic flux density peak downstream of the other position in the direction in which said developer carrier is rotated.

8. An image forming method, comprising the steps of:

magnetically adsorbing a magnetized developer onto a developer carrier by the action of a magnetic field generated by a magnetic field generating device to form a magnetic lobe;

regulating the amount of said developer in said magnetic lobe in accompaniment with rotation of said developer carrier about a longitudinal central-axis by a developer regulating member disposed in a developer carrier rotating angular region extending from a position of a normal magnetic flux density inflection point, at which a component of said magnetic field normal to said developer carrier becomes zero, to a position of a normal magnetic flux density peak, at which said component of said magnetic field normal to said developer carrier exhibits a maximum value, in a direction in which said developer carrier is rotated; and developing a latent image on an image carrier using said magnetic lobe having a regulated amount of said developer, wherein said magnetic field is generated such that a position of a tangential magnetic flux density peak, at which a component of said magnetic field tangential to said developer carrier exhibits said maximum value, immediately upstream of said developer regulating member in the direction in which said developer carrier is rotated, is positioned upstream of said position of the normal magnetic flux density inflection point in the direction in which said developer carrier is rotated.

9. An image forming apparatus comprising:

an image carrier;

a non-magnetic sleeve serving as a developer carrier rotatable about a longitudinally central axis;

magnetic field generating device having a plurality of magnetic poles fixedly disposed in series in an internal space of said sleeve in a direction in which said developer carrier is rotated, said magnetic field generating device generating a magnetic field for holding a developer having a magnetized surface; and a developer regulating member for regulating the amount of developer held on the surface of said developer carrier and transported to a developing position, said developer regulating member being disposed in a peripheral region of said developer carrier, said peripheral region extending between two magnetic poles outwards of said plurality of magnetic poles, said two magnetic poles being positioned adjacent to each other in the direction in which said developer carrier is rotated, within an angular range in which said developer carrier is rotated, said angular range extending from a position of a normal magnetic flux density inflection point, at which a component of said magnetic field normal to said developer carrier becomes zero, to a position of a normal magnetic flux density peak, at which said component of said magnetic field normal to said developer carrier exhibits a maximum, in the direction in which said developer carrier is rotated, wherein a position of a tangential magnetic flux density peak, at which a component of said magnetic field tangential to said developer carrier exhibits a maximum, is disposed upstream of the position of the normal magnetic flux density inflection point in the direction in which said developer carrier is rotated, between said two magnetic poles.

10. The image forming apparatus according to claim 9, wherein said position of the tangential magnetic flux density peak is disposed upstream of said position of normal magnetic flux density inflection point by at least 3° in the direction in which said developer carrier is rotated.

11. The image forming apparatus according to claims 9 or 10, wherein two positions of peak normal magnetic flux density peaks lying in proximity with each other on both sides of said developer regulating member are such that a normal magnetic flux density at the position of the normal magnetic flux density peak laying upstream in the direction in which said developer carrier is rotated is larger than a normal magnetic flux density at the position of the normal magnetic flux density peak laying downstream in the direction in which said developer carrier is rotated.

12. The image forming apparatus according to claim 11, wherein the normal magnetic flux density at the position of the normal magnetic flux density peak laying upstream in the direction in which said developer carrier is rotated is larger by 150 G or more than the normal magnetic flux density at the position of the normal magnetic flux density peak lying downstream in the direction in which said developer carrier is rotated.

13. The image forming apparatus according to claim 9, wherein said position of the tangential magnetic flux density peak is located upstream of a median point of two tangential magnetic flux density zero positions at which a tangential component of the magnetic flux is zero before and after said position of the tangential magnetic flux density peak in the direction in which said developer carrier is rotated.

14. The image forming apparatus according to claim 9, wherein two positions of normal magnetic flux density peaks laying in proximity with each other on both sides of said developer regulating member are such that a one-half value of a central angular width of a normal magnetic flux density distribution including the position of the normal magnetic flux density peak upstream of the other position in the direction in which said developer carrier is rotated is wider than a half value of a central angular width of a normal magnetic flux density distribution including the position of the normal magnetic flux density peak downstream of the other position in the direction in which said developer carrier is rotated.

* * * * *